US009015964B2

(12) United States Patent
Naismith-Beeley

(10) Patent No.: US 9,015,964 B2
(45) Date of Patent: Apr. 28, 2015

(54) SHOE HEEL SUPPORT DEVICE

(75) Inventor: Mark Naismith-Beeley, Balmain (AU)

(73) Assignee: Ilde Naismith-Beeley, New South Wales (AU)

( * ) Notice: Subject to any disclaimer, the term of this patent is extended or adjusted under 35 U.S.C. 154(b) by 1022 days.

(21) Appl. No.: 13/057,025

(22) PCT Filed: Aug. 3, 2009

(86) PCT No.: PCT/AU2009/000987

§ 371 (c)(1),
(2), (4) Date: Aug. 26, 2011

(87) PCT Pub. No.: WO2010/012047

PCT Pub. Date: Feb. 4, 2010

(65) Prior Publication Data

US 2011/0314704 A1 Dec. 29, 2011

(30) Foreign Application Priority Data

Aug. 1, 2008 (AU) ..... 2008903955

(51) Int. Cl.

| | |
|---|---|
| ***A43B 13/14*** | (2006.01) |
| ***A43B 21/36*** | (2006.01) |
| ***A43B 13/22*** | (2006.01) |
| ***A43C 15/04*** | (2006.01) |
| ***A43B 13/00*** | (2006.01) |
| ***A43B 1/00*** | (2006.01) |
| ***A43B 3/16*** | (2006.01) |

(52) U.S. Cl.

CPC ..... *A43C 15/04* (2013.01); *A43B 13/00* (2013.01); *A43B 1/0018* (2013.01); *A43B 3/166* (2013.01)

(58) Field of Classification Search

CPC ..... A43B 13/34; A43B 13/36; A43B 13/00; A43B 21/22; A43B 21/24; A43B 21/26; A43B 21/00; A43B 21/42

USPC .. 36/72 B, 72 R, 136, 100, 34 R, 35 A, 35 B; D2/968, 965, 915

See application file for complete search history.

(56) References Cited

U.S. PATENT DOCUMENTS 2,456,206 A * 12/1948 Martinelli et al. ..... 36/70 R
2,875,534 A 3/1959 Grossman
3,045,365 A * 7/1962 Bingham, Jr. ..... 36/7.3

(Continued)

FOREIGN PATENT DOCUMENTS

DE 1845326 U 1/1962
WO WO-2007/124534 A1 11/2007

OTHER PUBLICATIONS

International Search Report and Written Opinion for corresponding international application No. PCT/AU2009/000987, dated Sep. 21, 2009.

(Continued)

*Primary Examiner* — Jila M Mohandesi
(74) *Attorney, Agent, or Firm* — Marshall, Gerstein & Borun LLP

(57) ABSTRACT

A shoe heel support device including a ground contacting base portion and a resilient shoe heel engagement portion attached to the ground contacting base portion, the resilient shoe heel engagement portion including at least three lobe portions each having an inner surface together defining a bore for receiving a shoe heel therein, the dimension of the bore smaller than the cross-sectional dimension of the shoe heel.

20 Claims, 6 Drawing Sheets

(56) References Cited

U.S. PATENT DOCUMENTS

| | | | | | |
|---|---|---|---|---|---|
| 3,077,679 | A | * | 2/1963 | Hanko et al. | 36/7.3 |
| 3,122,848 | A | * | 3/1964 | Grossman | 36/7.3 |
| 3,150,453 | A | | 9/1964 | Tilden | |
| 3,439,435 | A | * | 4/1969 | Fredon | 36/72 R |
| 5,044,097 | A | * | 9/1991 | Young | 36/72 B |
| 5,311,675 | A | * | 5/1994 | Topel | 36/72 B |
| D575,946 | S | * | 9/2008 | Mitani et al. | D2/967 |
| 2002/0133980 | A1 | * | 9/2002 | Pan | 36/100 |
| 2008/0196279 | A1 | | 8/2008 | Epping | |

OTHER PUBLICATIONS

International Preliminary Report on Patentability for corresponding international application No. PCT/AU2009/000987, dated Feb. 1, 2011.

* cited by examiner

SHOE HEEL SUPPORT DEVICE

CROSS-REFERENCE TO RELATED APPLICATIONS

This is the U.S. national phase of International Application No. PCT/AU2009/000987, filed Aug. 3, 2009, which claims the benefit of Australian Patent Application No. 2008903955, filed Aug 1, 2008.

FIELD OF THE INVENTION

The present invention relates to a support device for a shoe heel to provide as supporting platform for the heel of the shoe, such as providing support for a stemmed or high heel, particularly useful for preventing or inhibiting the deal from sinking into a surface when issue is being worn will stop

BACKGROUND ART

Devices similar to that of the present invention are available. One such device is described in International Patent to Publication No. WO 2007/124534 which also contains a useful description of the prior art to date. A section of the "Background of the Invention" portion of that document is as follows verbatim:

"It is well known that there is a large number of different types of footwear, including shoes that cater for different functions and fashions. Women's shoes, in particular, are often equipped with a raised or high heel. In many instances, the design of the heel is such that the heel is relatively narrow in width, with the heel essentially consisting of an elongate stem. An example of this is the known stiletto heel. However, there are many other different types of heel designs that generally consist of a stemmed shape or configuration. A problem that may be encountered by a person wearing shoes with such a heel is that the heel may sink into the ground that is being walked upon. This is a particular problem when the ground is soft, such as sand or grass. In these instances, it can become difficult for the person to walk upon such a surface, as the heel must often be pulled out of the ground with each step. A similar problem can be encountered when the ground is relatively unstable, such as when walking on a gravel road or path. In such an event, the narrow stein structure of the heel can sink in between rocks or pebbles that make up the ground. This may lead to general instability for the person walking thereon, thereby increasing the possibility of injury by, for example, falling and spraining or twisting an ankle. In addition, in such circumstances, there is also the capacity for causing damage to the shoe, in particular the heel. The likelihood of damage to the shoe is greater for those shoes that are manufactured from delicate materials, such as suede or fine fabrics. Unfortunately, it is often the case that such shoes are most often the most expensive to buy and their subsequent repair or replacement may come at significant expense to their owner.

Similar safety and shoe maintenance problems can also be encountered when high heeled shoes are worn whilst walking upon a surface that has numerous or significant gaps, for example, upon planks of a decking surface. The present, invention attempts to overcome at least in part the aforementioned disadvantages and problems that may be encountered whilst wearing raised or high heeled shoes, particularly whilst standing or walking upon surfaces that are soft, unstable or generally uneven."

The above tract of discussion highlights the issues faced by a device of the general kind of that of the present invention.

It will be clearly understood that, if a prior art publication is referred to herein, this reference does not constitute an admission that the publication forms part of the common general knowledge in the art in Australia or in any other country.

SUMMARY OF THE INVENTION

The present invention is directed to a shoe heel support device, which may at least partially overcome at least one of the abovementioned disadvantages, an alternative with some advantage or provide the consumer with a useful or commercial choice.

With the foregoing in view, the present invention in one form, resides broadly in a shoe heel support device including a ground contacting base portion and a resilient shoe heel engagement portion attached to the ground contacting base portion, the resilient shoe heel engagement portion including at least three lobe portions each having an inner surface together defining a bore for receiving a shoe heel therein, the dimension of the bore smaller than the cross-sectional dimension of the shoe heel.

The ground contacting base portion is typically larger in cross-sectional dimension than the heel in order to spread the load and to support the heel.

The base portion is typically configured as a planar member with at least one and normally a number of upright extensions. These extension portions are preferably shaped to engage with the resilient heel engagement portion. Typically the upright portions will both attach and stabilise the heel engagement portion. The upright portions are normally arrayed in a circular configuration about the bore of the device and extend upwardly into but not through the heel engagement portion. These upright portions may provide the device, and more particularly the resilient heel engagement portion with increased stiffness or rigidity.

The base portion may also have a number of downwardly extending feet portions spread about the base portion. These feet portions will preferably act to provide a wear surface on the lower surface of the device in order that the heel engagement portion, which is normally softer than the base portion, not be unduly worn through contact with the ground surface during use. The feet portions will typically be spread about the base portion as well.

The base portion will normally be manufactured in a unitary manner or rigid plastic or similar. The design and features of the base portion will typically also result in through flow of the material used to form the resilient shoe heel engagement portion, normally by moulding the resilient shoe heel engagement portion about the ground contacting base portion.

The ground contacting base portion may include one or more openings therein to allow accumulated fluid to drain from the device. The ground contacting portion may also have portions therein adapted to allow the heel engagement portion to engage more securely with the ground contacting base portion in embodiments where the two are not integrally formed.

The heel engagement portion will typically be a unitary member with a number of features.

The heel engagement portion will typically be manufactured from a resilient material. As such, the configuration of the heel engagement portion will preferably be biased inwardly to grip the heel once the heel is inserted into the bore.

The heel engagement portion will typically include a number of lobes spaced about the bore. Normally, the heel engagement portion is generally toroidal in shape with a number of lobes forming the generally toroidal portion. Therefore, each lobe will typically be formed from a portion of the toroidal shape, the lobes separated by providing slots between them.

The slots between the lobes may extend substantially from the top of the generally toroidal shape to a region closely adjacent to the ground contacting portion or alternatively, the slots may extend only a short distance downwardly. Adjusting the height of the slots will typically adjust the degree of resilience of the lobes relative to the bore.

According to this embodiment, the heel engagement portion will typically be manufactured from a resilient plastic, typically one that has a clear appearance. The plastic may be coloured or otherwise adapted with either an integral or surface finish in order to render in the device aesthetically pleasing. According to the most preferred embodiment, five lobes will be provided and the device will resemble a flower when viewed from above.

The heel engagement portion may alternatively be formed from a plurality of lobes which are mounted for resilient movement relative to the bore. According to this embodiment, the lobes may be provided as a plurality of beads. Typically, the beads are spaced about the edge of the ground contacting portion to leave the bore in the centre. The beads are typically attached to each other and to the ground contacting portion using one or more resilient or elastic members.

In this way, as the heel of the shoe is forced into the bore, the lobes, regardless of whether provided as beads or lobes or otherwise, are deformed outwardly in order to allow passage of the heel, and also to grip the heel once inserted.

If necessary, the device may be provided with more rigid or stiff interconnections between the lobes or beads. This may be used in situations where it is found that the device does not engage with the shoe heel securely enough and may come loose. Of course, increased rigidity may be provided by at least partially connecting the lobes to each other and both adjacent the bore and at other portions between the lobes. If required, additional resilient means may be provided in association with the lobes in order to provide sufficient stiffness or resistance against the resilient deformation.

The bore itself will typically be substantially circular but it may be shaped differently as shoe heels are typically D-shaped in cross-section. Therefore, the bore may be D-shaped as well.

Depending upon the preferred embodiment, the bore may have a substantially continuous sidewall extending from the upper portion of the device to a region adjacent the ground contacting member. Alternatively, the bore may be formed by portions of the lobes and have a discontinuous sidewall due to the slots between the lobes.

Normally, the bore will have a larger dimension in a region adjacent to the ground contacting member and a smaller dimension at an upper region. In this manner, the upper region will typically act to grip the shoe heel whilst the larger dimension lower down allows clearance for the heel pad of the shoe (which is typically slightly larger than the shoe heel itself).

In the region of the bore, the ground contacting member may be provided with one or more openings in order to allow any accumulated fluid drained from the device.

Preferably, the device of the preferred embodiment will be configured to provide a gradual increase in the surface area of the device as the device abuts relatively soft ground.

According to another embodiment, the invention resides in a shoe having a heel with a support device including a ground contacting base portion and a resilient shoe heel engagement portion attached to the ground contacting base portion, the resilient shoe heel engagement portion including at least three lobe portions each having an inner surface together defining a bore for receiving a shoe heel therein, the dimension of the bore smaller than the cross-sectional dimension of the shoe heel.

The device of the present invention is sized for a combination of aesthetics, and not interfering with walking (snowshoe/flipper effect) but still being large enough to function of inhibiting penetration of the heel of the shoe into relatively soft ground.

Also by using the "outwardly deformed lobes" and not relying on a sleeve/vacuum/friction method to provide the adhesion to the heel, the device reduces the height of the device to a minimum to leave more of the heel uncovered and improving aesthetics but also for keeping the device compact so that it can be carried discreetly in a clutch purse etc.

BRIEF DESCRIPTION OF THE DRAWINGS

Various embodiments of the invention will be described with reference to the following drawings, in which.

DETAILED DESCRIPTION OF THE PREFERRED EMBODIMENT

According to a particularly preferred embodiment, a shoe heel support device is provided. In the illustrated embodiments, the same reference numbers are used to refer to the same component parts in FIGS. 1-11, but the reference numbers are not in conformity in FIG. 12.

Figure 1:
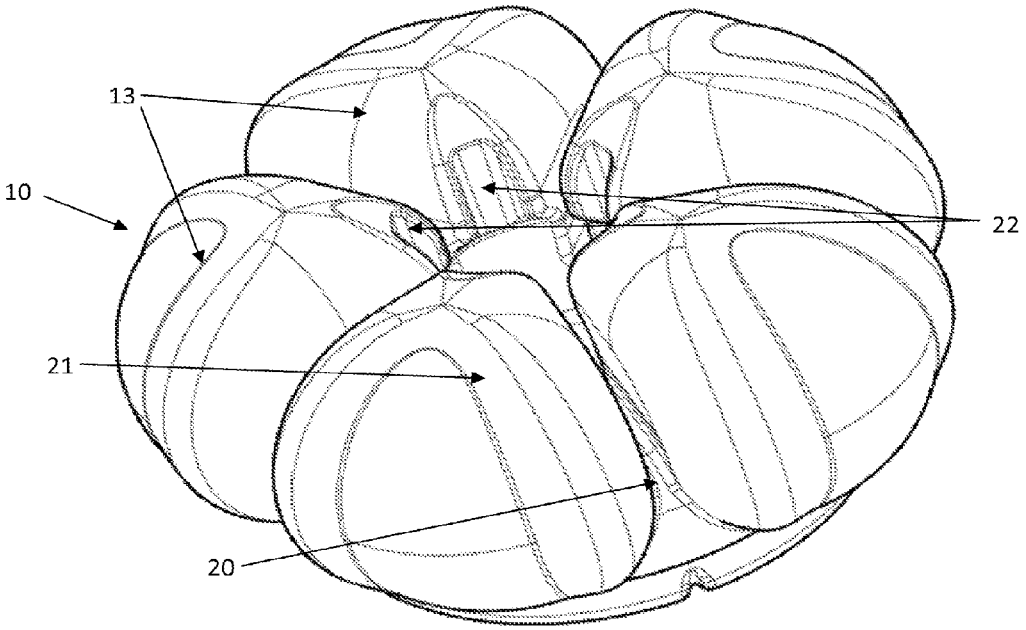
FIG. 1 is a perspective view from above of a shoe heel support device according to a preferred embodiment of the present invention.
Figure 2:
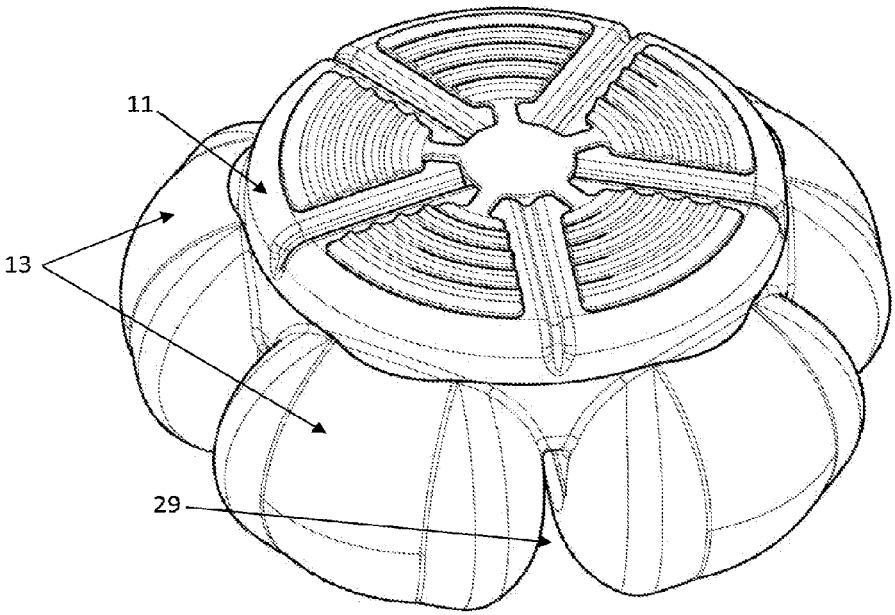
FIG. 2 is a perspective view from below of the shoe heel support device illustrated in FIG. 1.
Figure 3:
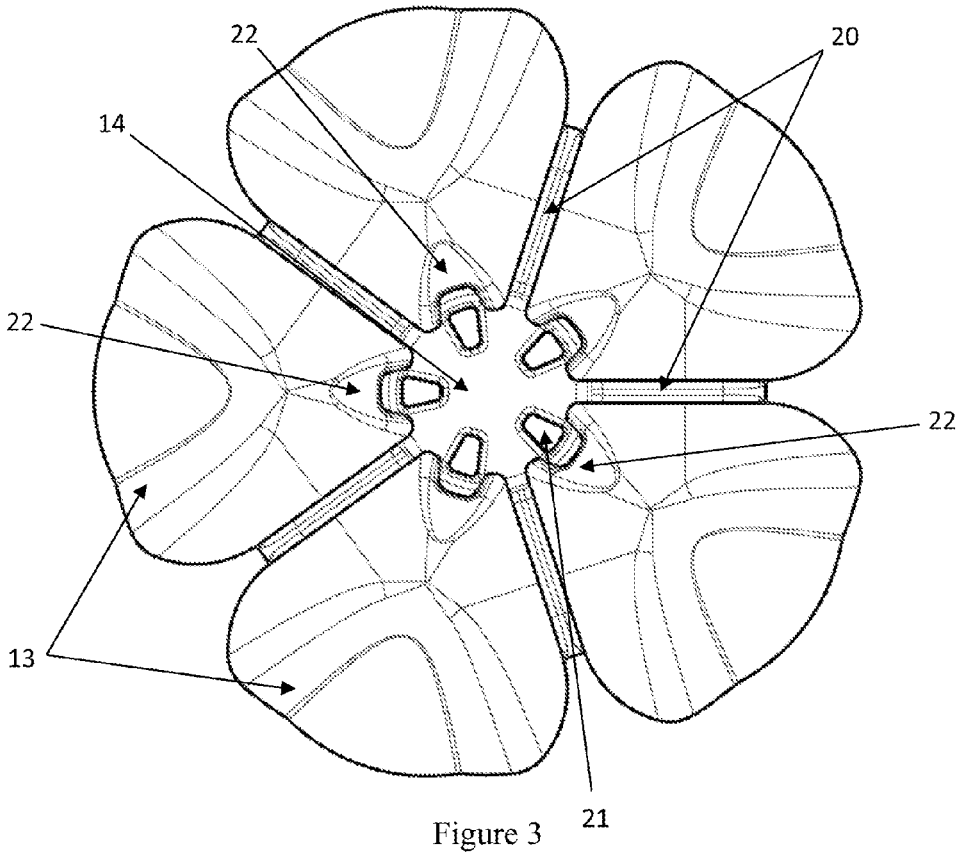
FIG. 3 is a view from above of the device illustrated in FIG. 1.
Figure 4:
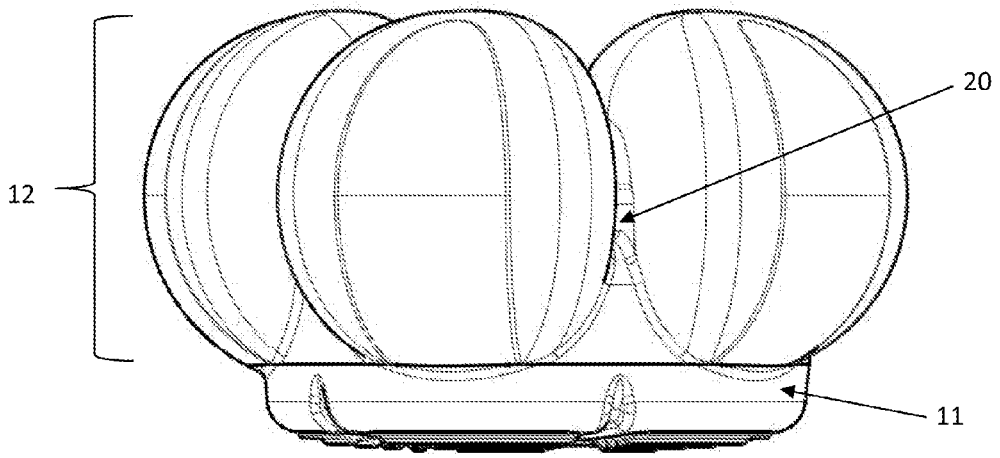
FIG. 4 is a view from the side of the device illustrated in FIG. 1.
Figure 5:
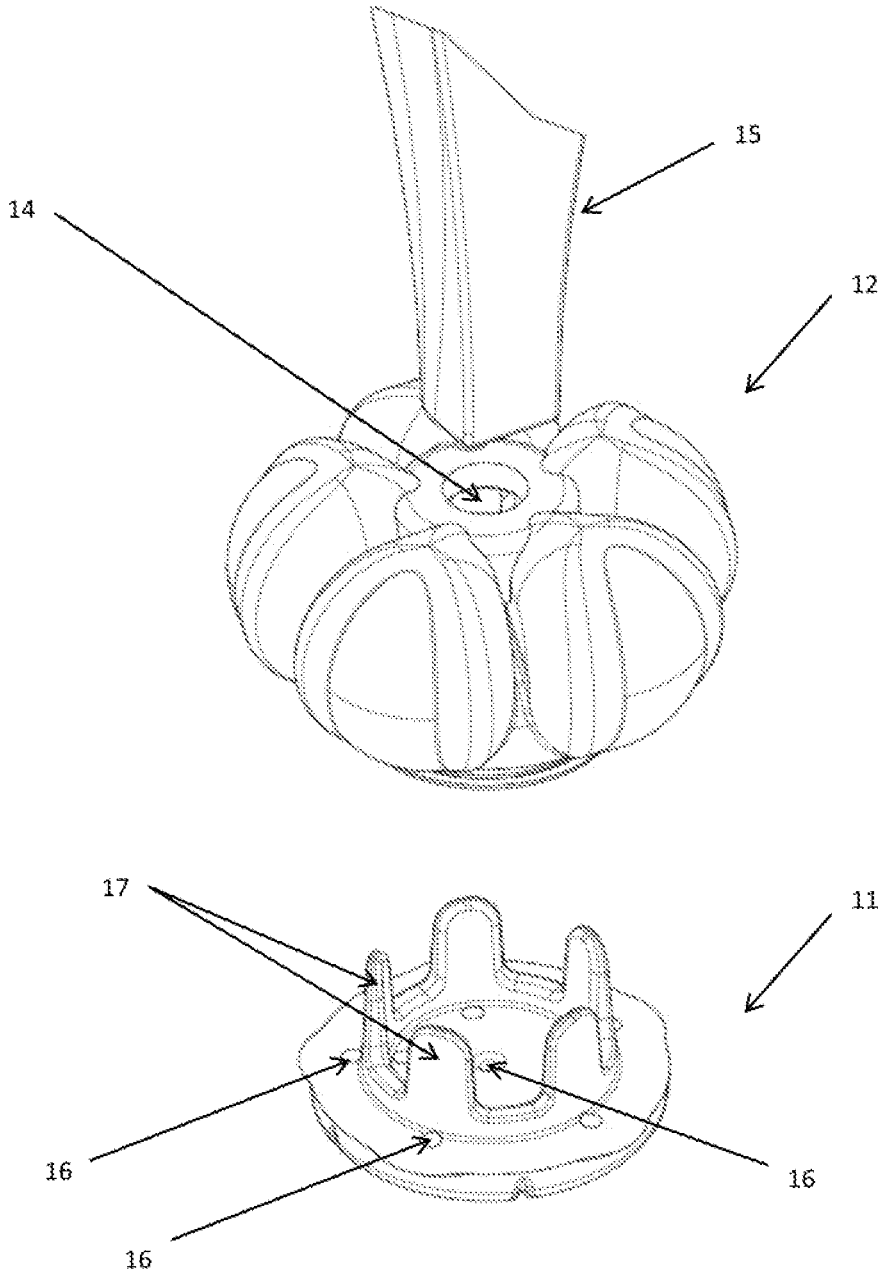
FIG. 5 is an exploded view of a shoe heel support device according to a preferred embodiment of the present invention.

Referring to the drawings, particularly FIGS. 1-4, the embodiment of the shoe heel support device has a substantially unitary configuration when assembled but has a pair of components as illustrated in FIG. 5.

Figure 7:
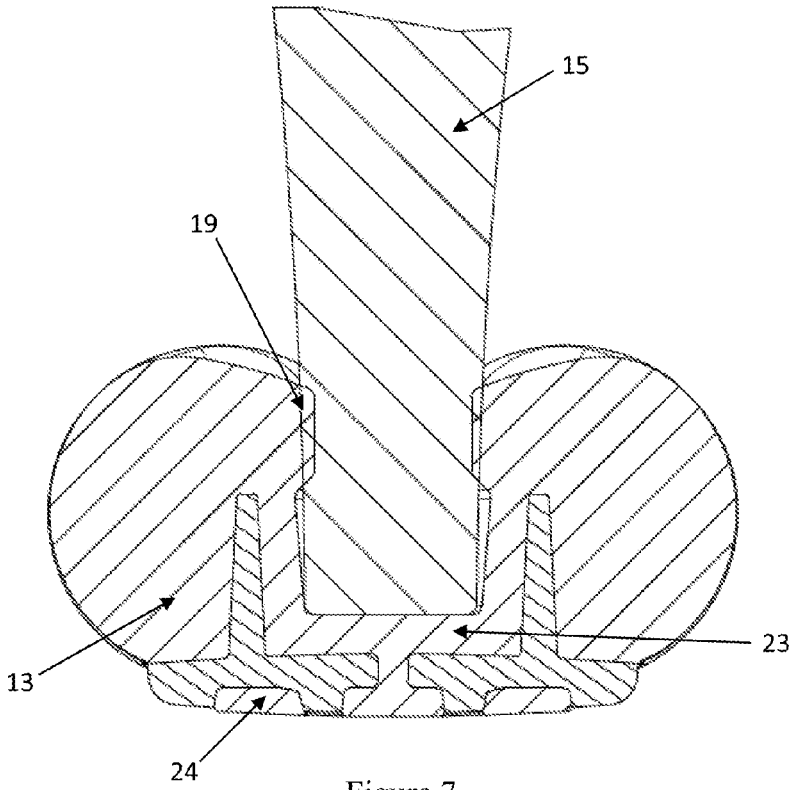
FIG. 7 is a sectional view from the side of a shoe heel support according to a preferred embodiment of the present invention.
Figure 8:
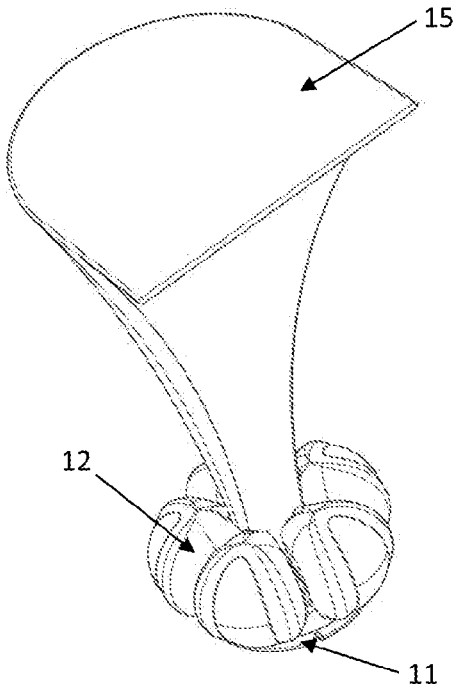
FIG. 8 is a perspective view from above of a device according to a preferred embodiment of the present invention attached to the shoe heel.
Figure 9:
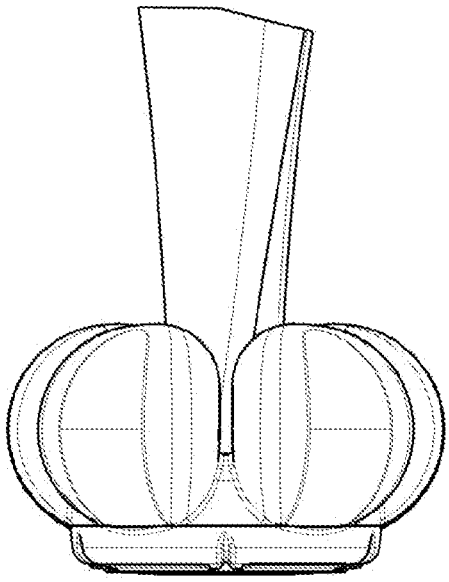
FIG. 9 is a view from the side of the configuration illustrated in FIG. 8.
Figure 10:
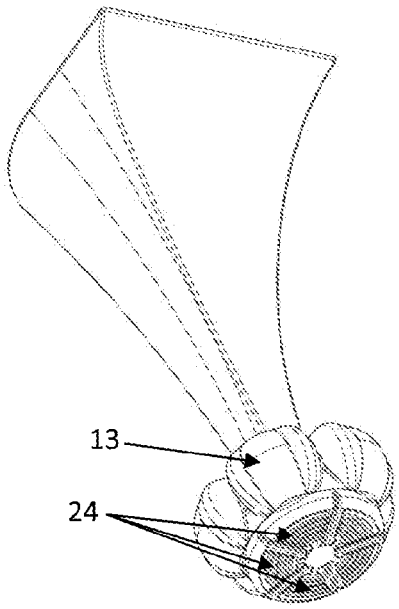
FIG. 10 is a perspective view from below of the configuration illustrated in FIG. 8.
Figure 11:
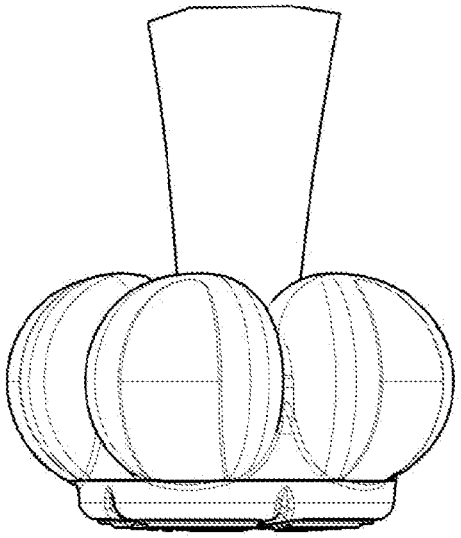
FIG. 11 is a view from the rear of the configuration illustrated in FIG. 8.

The shoe heel support 10 illustrated the figures includes a ground contacting base 11 and a resilient shoe heel engagement portion 12 attached to the ground contacting base 11. The resilient shoe heel engagement portion of the illustrated embodiment includes five lobe portions 13 each having an inner surface which together define a bore 14 for receiving a shoe heel 15 therein in an interference fit 19 as illustrated in FIG. 7.

As illustrated in the Figures, the device 10 has a generally toroidal shape. The ground contacting base 11 provided on the lower side of the device extends over the lower end of the bore 14 to close the bore 14 such that when a shoe heel is located correctly within the bore 14 and weight is placed on the shoe, the shoe pad at the lower end of the shoe heel abuts the ground contacting base 11. The heel engagement portion 12 has a cushion portion 23 in the bore 14 above the ground contacting base and anti-slip portions 24 below.

The through flow of resilient material will also have the effect of forming portions on the underside of the device of the resilient material. Given the properties of the material, these portions will also function as low-friction, non-slip feet to increase grip.

Figure 6:
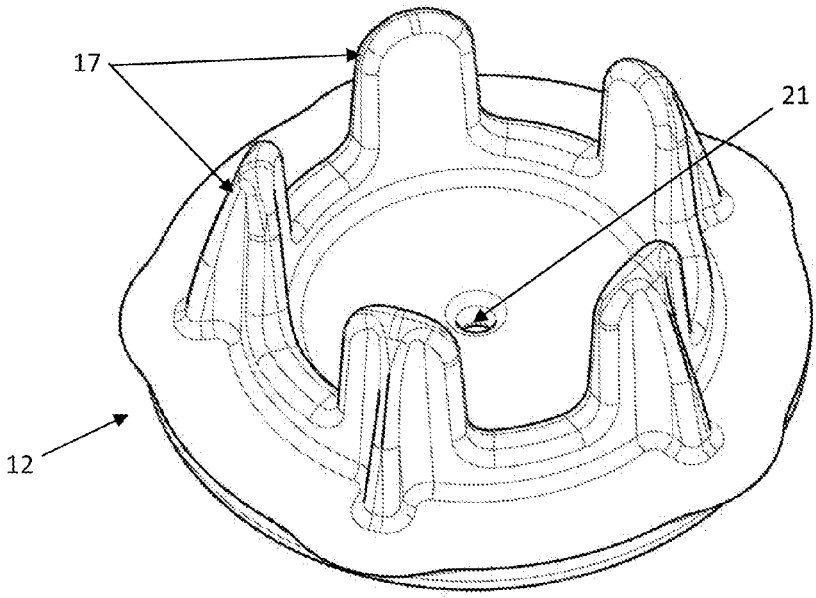
FIG. 6 is a perspective view from above of a ground contacting base portion of a preferred embodiment.

The ground contacting base 11 is larger in cross-sectional dimension than the shoe heel in order to spread the load and to support the heel. As illustrated in FIG. 5, the base portion 11 is a substantially circular plate member with a number of openings 16 therethrough. An alternative embodiment of the ground contacting base is illustrated in FIG. 6 with a single central opening 16.

The openings 16 allow through flow of the material used to form the resilient shoe heel engagement portion 12, normally by moulding the resilient shoe heel engagement portion 12 about the ground contacting base 11.

The base portion 11 also has a number of upwardly protruding extensions 17. These upward extensions 17 protrude upwardly from the upper surface of the base 11 shaped to engage with the resilient heel engagement portion 12 to both attach and stabilise the heel engagement portion 12. The upward extensions 17 are arrayed in a circular configuration about the bore 14 of the device 10 and extend upwardly into but not through the heel engagement portion 12.

The base 11 also has a number of downwardly extending feet 18 spread about the base 11. These feet 11 will act to provide a wear surface on the lower surface of the device in order that the heel engagement portion 12, which is normally softer than the base 11, not be unduly worn through contact with the ground surface during use. The feet 18 are spread about the base portion as illustrated in FIG. 7.

The heel engagement portion 12 of the illustrated embodiments is a unitary member. The heel engagement portion 12 is manufactured from a resilient material. As such, the configuration of the heel engagement portion is biased inwardly to grip the heel once the heel is inserted into the bore 14.

The heel engagement portion 12 of the illustrated embodiments include a number of lobes 13 spaced about the bore 14. As stated above, the heel engagement portion 12 is generally toroidal in shape with five lobes 13 forming the generally toroidal portion. Therefore, each lobe 13 formed from a segmental portion of the toroidal heel engagement portion 12, the lobes 13 separated by providing slots 20 between them.

Adjusting the height of the slots 13 will typically adjust the degree of resilience of the lobes 13 relative to the bore 13. The slots 20 between the lobes 13 of the device illustrated in FIGS. 5, 7 and 8-11 for example extend substantially from the top of the generally toroidal heel engagement portion 12 to a region closely adjacent to the ground contacting base 11 whereas, the slots 20 between the lobes 13 of the device illustrated in FIGS. 1-4 for example, extend only a short distance downwardly.

According to illustrated embodiments, the heel engagement portion 12 is manufactured from a resilient plastic, with a clear but coloured appearance. According to the illustrated embodiment, the five lobes 13 provided has the device resemble a flower when viewed from above.

The lobes 13 are mounted for resilient movement relative to the bore 14. In this way, as the heel 15 of the shoe is forced into the bore 14, the lobes 13 are deformed outwardly in order to allow passage of the heel, and also to grip the heel once inserted.

The bore 14 of the illustrated embodiment is substantially circular but it may be shaped differently as shoe heels are typically D-shaped in cross-section.

Depending upon the embodiment, the bore 14 may have a substantially continuous sidewall extending from the upper portion of the device to a region adjacent the ground contacting base 11, as illustrated in FIGS. 5, 7 and 8-11. Alternatively as illustrated in FIGS. 1 to 4, the bore may be formed by inner surfaces 22 of the respective lobes 13 and have a discontinuous sidewall due to the slots 20 between the lobes 13.

Normally, the bore 14 has a larger dimension in a region adjacent to the ground contacting base 11 and a smaller dimension at an upper region to create the interference fit 19. In this manner, the upper region will typically act to grip the shoe heel whilst the larger dimension lower down allows clearance for the heel pad of the shoe (which is typically slightly larger than the shoe heel itself).

In the region of the bore 14, the ground contacting base 11 can be provided with one or more openings 21 in order to allow any accumulated fluid drained from the device.

Figure 12:
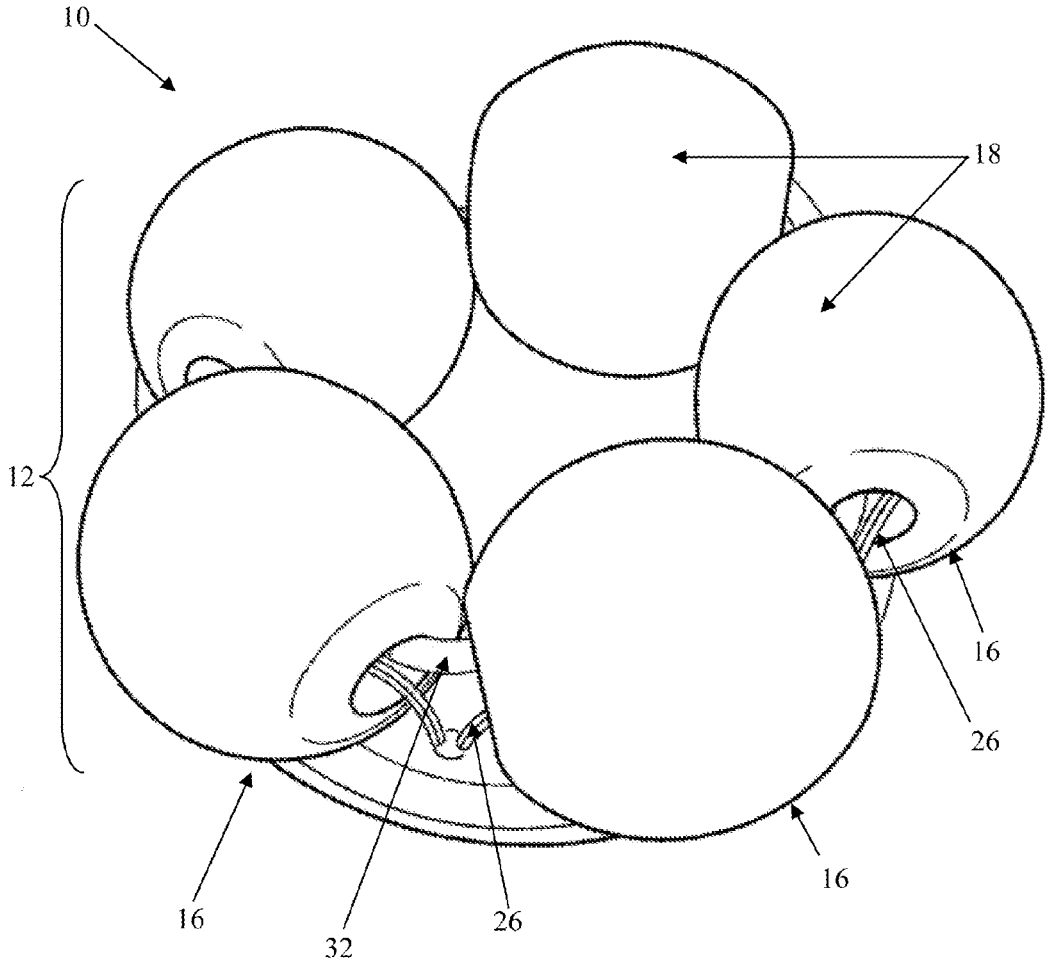
FIG. 12 is a perspective view from above of an alternative embodiment of the preset invention.

Referring to FIG. 12, there is illustrated a support attachment generally indicated at 10, the support attachment attachable to the heel of a shoe (not shown). The support attachment 10 includes a bolster 12, which when mounted on the heel bolsters a substantial portion of the heel above a ground level by inhibiting penetration of an upper portion of the heel into relatively soft ground. The bolster 12 in use, is mounted to the heel at a selected distance from a base of the heel so as to facilitate a normal walking gait for a wearer (not shown) when walking on relatively hard ground.

The bolster 12 includes includes a plurality of bulbous regions 16 so as to facilitate a gradual increase in the surface area of the support surface once the support surface abuts the relatively soft ground.

Furthermore, each bulbous region 16 is a portion of a respective bead 18 so as to facilitate insertion of the base of the heel into the support attachment. The beads 18 may be coated or otherwise treated with a high-friction surface for improved grip on the heel shaft.

In the illustrated embodiment, there are five beads 18 which are arranged in a generally circular formation and in a plane which in use, is disposed parallel to the ground level.

A platform 22 is provided and generally sized so that it is approximately the same area as the base of the heel. The platform 22 is constructed from thin durable rubber which, if larger in size than base of the heel, will simply form a cup by conforming to the heel shaft.

The device 10 may include a plurality of connecting rods for spacing the bolster 12 in the form of the beads 18 from the platform of the heel. Alternatively, and has illustrated, the device 10 may be configured such that the beads 18 but an upper surface of the platform 22. The beads are attached to the platform using and elongate flexible fastener 26.

The device 10 further includes a resilient band 32 which extends through the beads 18 so as to maintain the beads 18 against the heel and to allow a certain relaxation during loading of the heel base into the bolster 12.

In the present specification and claims (if any), the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A shoe heel support device including:

a ground contacting base portion and a resilient shoe heel engagement portion attached to the ground contacting base portion, the resilient shoe heel engagement portion including:

at least three lobe portions spaced radially from one another, each of the lobe portions having an inner surface together defining a bore for receiving a shoe heel therein, a dimension of the bore being smaller than a cross-sectional dimension of the shoe heel, the support device being removably attachable to a shoe heel wherein the lobe portions define the bore and are mounted for resilient movement relative to the bore and at least an upper portion of an outer surface of the resilient shoe heel engagement portion is discontinuous, and wherein a lower portion of each of the lobe portions is connected to at least one adjacent lobe portion and an upper portion of each of the lobe portions is disconnected from at least one adjacent lobe portion.

2. A shoe heel support device as claimed in claim 1 wherein the ground contacting base portion is larger in cross-sectional dimension than the shoe heel to spread the load and to support the heel.

3. A shoe heel support device as claimed in claim 1 wherein the base portion includes a planar member with at least one upright extension shaped to engage with the resilient heel engagement portion.

4. A shoe heel support device as claimed in claim 3 wherein a plurality of upright portions are provided arrayed in a circular configuration about the bore of the device and extend upwardly into but not through the heel engagement portion.

5. A shoe heel support device as claimed in claim 1 wherein the base portion has a number of downwardly extending feet portions spread about the base portion to provide a wear surface on the lower surface of the device.

6. A shoe heel support device as claimed in claim 1 wherein the base portion has a framework structure comprising channels which allow through flow of material used to form the resilient shoe heel engagement portion.

7. A shoe heel support device as claimed in claim 6 wherein the base portion and the resilient shoe heel engagement portion are attached to one another by molding the resilient shoe heel engagement portion about the ground contacting base portion.

8. A shoe heel support device as claimed claim 1 wherein the heel engagement portion is formed from a resilient material, shaped and biased inwardly to grip the heel once the heel is inserted into the bore.

9. A shoe heel support device as claimed in claim 1 wherein the resilient shoe heel engagement portion and the ground contacting base portion are separable.

10. A shoe heel support device as claimed in claim 1 wherein the heel engagement portion is generally toroidal in shape with a number of lobes forming the generally toroidal portion.

11. A shoe heel support device as claimed in claim 1 wherein each lobe is formed from a portion of the toroidal shape, the lobes separated by providing slots between them.

12. A shoe heel support device as claimed in claim 11 wherein the height of the slots determines the degree of resilience of the lobes relative to the bore.

13. A shoe heel support device as claimed in claim 1 wherein the lobes are provided as a plurality of beads spaced about the edge of the ground contacting portion to leave the bore in the center, the beads being attached to each other and to the ground contacting portion using one or more resilient or elastic members.

14. A shoe heel support device as claimed in claim 1 wherein the bore has substantially continuous sidewall extending from the upper portion of the device to a region adjacent the ground contacting member.

15. A shoe heel support device as claimed in claim 1 wherein the bore has a discontinuous sidewall due to expansion slots provided in the sidewall.

16. A shoe heel support device as claimed in claim 1 wherein the device is configured to provide a gradual increase in the surface area of the device as the device abuts relatively soft ground.

17. A shoe heel support device as claimed in claim 1 wherein the ground contacting base portion includes at least one opening therein to allow accumulated fluid to drain from the device.

18. A shoe having a heel with a support device including a ground contacting base portion and a resilient shoe heel engagement portion attached to the ground contacting base portion, the resilient shoe heel engagement portion including at least three lobe portions spaced radially from one another, each of the lobe portions having an inner surface together defining a bore for receiving a shoe heel therein, a dimension of the bore being smaller than a cross-sectional dimension of the shoe heel, the support device being removably attachable to a shoe heel wherein the lobe portions define the bore and are mounted for resilient movement relative to the bore and at least an upper portion of an outer surface of the resilient shoe heel engagement portion is discontinuous, and wherein a lower portion of each of the lobe portions is connected to at least one adjacent lobe portion and an upper portion of each of the lobe portions is disconnected from at least one adjacent lobe portion.

19. A shoe heel support device as claimed in claim 1 wherein the resilient shoe heel engagement portion is molded about the base portion.

20. A shoe heel support device as claimed in claim 8 wherein the lobes are deformable outwardly to allow passage of the heel.

* * * * *